US009327153B2

(12) United States Patent
Wallisch

(10) Patent No.: US 9,327,153 B2
(45) Date of Patent: May 3, 2016

(54) MULTI-PURPOSE EXERCISE DEVICE

(71) Applicant: Praetorian Fitness Products, Inc., Carlisle, PA (US)

(72) Inventor: Michael Dane Wallisch, Carlisle, PA (US)

(73) Assignee: Praetorian Fitness Products, Inc., Carlisle, PA (US)

( * ) Notice: Subject to any disclaimer, the term of this patent is extended or adjusted under 35 U.S.C. 154(b) by 175 days.

(21) Appl. No.: 14/199,349

(22) Filed: Mar. 6, 2014

(65) Prior Publication Data

US 2014/0287881 A1 Sep. 25, 2014

Related U.S. Application Data

(60) Provisional application No. 61/804,312, filed on Mar. 22, 2013.

(51) Int. Cl.

| | |
|---|---|
| ***A63B 3/00*** | (2006.01) |
| ***A63B 1/00*** | (2006.01) |
| ***A63B 21/068*** | (2006.01) |
| ***A63B 23/12*** | (2006.01) |
| ***A63B 21/00*** | (2006.01) |

(52) U.S. Cl.

CPC ..... *A63B 3/00* (2013.01); *A63B 21/00047* (2013.01); *A63B 21/068* (2013.01); *A63B 21/4029* (2015.10); *A63B 23/1218* (2013.01); *A63B 23/1227* (2013.01); *A63B 23/1236* (2013.01); *A63B 1/00* (2013.01); *A63B 2210/50* (2013.01)

(58) Field of Classification Search

CPC ..... A63B 1/00; A63B 9/00; A63B 17/00; A63B 17/02; A63B 17/04; A63B 21/00047; A63B 21/0005; A63B 21/00054; A63B 21/16; A63B 21/1609; A63B 21/1618; A63B 21/1627; A63B 21/1636; A63B 21/1645; A63B 21/1654; A63B 21/1663; A63B 21/1675; A63B 21/1681; A63B 21/169; A63B 21/4029; A63B 21/068; A63B 21/1457; A63B 23/1218; A63B 23/1227; A63B 23/1236; A63B 23/1209; A63B 23/12; A63B 2208/0285; A63B 2208/029; A63B 2210/50

USPC ..... 482/38–42, 95–96

See application file for complete search history.

(56) References Cited

U.S. PATENT DOCUMENTS

| | | | | |
|---|---|---|---|---|
| 277,399 | A | 5/1883 | Worthington | |
| 2,200,902 | A * | 5/1940 | Solomon | E06C 7/48 182/108 |

(Continued)

*Primary Examiner* — Oren Ginsberg
*Assistant Examiner* — Joshua Lee
(74) *Attorney, Agent, or Firm* — The Webb Law Firm

(57) ABSTRACT

A multi-purpose exercise device includes a first side assembly having a first side assembly short side with an angled first side assembly front foot, a first side assembly long side with an angled first side assembly back foot, and a first elbow provided between the first side assembly short side and the first side assembly long side. The multi-purpose exercise device further includes a second side assembly located parallel to the first side assembly, the second side assembly having a second side assembly short side with an angled second side assembly front foot, a second side assembly long side with an angled second side assembly back foot, and a second elbow provided between the second side assembly short side and the second side assembly long side. At least one brace is provided for connecting the first side assembly to the second side assembly.

20 Claims, 8 Drawing Sheets

(56) References Cited

U.S. PATENT DOCUMENTS 2,666,640 A * 1/1954 Jennings, Sr. ..... A63B 3/00 482/141
3,379,434 A * 4/1968 Guzaldo ..... A63B 21/0005 482/139
3,540,724 A 11/1970 Hunter
3,920,240 A * 11/1975 Ross ..... A63B 21/00047 182/108
3,944,219 A * 3/1976 LoPresti ..... A63B 1/00 211/123
4,018,437 A * 4/1977 LoPresti ..... A63B 1/00 248/161
4,232,863 A * 11/1980 Roach ..... A63B 21/00047 482/141
4,638,995 A * 1/1987 Wilson ..... A63B 21/0004 297/452.13
4,666,154 A * 5/1987 Lipscomb ..... A63B 21/00047 482/142
D298,959 S 12/1988 DeGalvez
4,923,194 A * 5/1990 Montgomery ... A63B 21/00047 482/141
D320,823 S 10/1991 Tanner
5,080,352 A * 1/1992 Freed ..... A63B 21/00047 482/140
5,169,362 A 12/1992 Schwartz
5,234,391 A * 8/1993 Shasek ..... A63B 3/00 482/111
D353,420 S 12/1994 Koresec
D354,780 S 1/1995 Endelman
D354,781 S 1/1995 Endelman
5,407,404 A * 4/1995 Killian ..... A63B 21/0552 482/123
5,478,299 A 12/1995 Harmon et al.
5,697,875 A 12/1997 Stan
5,961,430 A 10/1999 Zuckerman et al.
6,203,473 B1 * 3/2001 Atwood ..... A63B 21/00047 482/142
6,375,601 B1 * 4/2002 Johnson ..... A61H 1/0292 297/452.13
6,409,640 B2 6/2002 Cournoyer
6,416,447 B1 7/2002 Harmon
6,695,754 B1 2/2004 Gazzolo
6,932,750 B1 8/2005 Dorner
7,294,100 B2 11/2007 Bull
7,357,761 B2 * 4/2008 Mattox ..... A63B 21/0004 482/125
7,658,702 B1 2/2010 Harms
D617,400 S 6/2010 Hetzel et al.
D633,962 S 3/2011 Stacey
D650,024 S 12/2011 Ivanov
2001/0004624 A1 6/2001 Cournoyer
2003/0004042 A1 * 1/2003 Burrell ..... A63B 21/00047 482/121
2004/0235627 A1 11/2004 Evminov
2005/0003938 A1 * 1/2005 Henderson ..... A63B 21/068 482/143
2005/0187083 A1 * 8/2005 Krystoff ..... A63B 21/00047 482/140
2010/0292058 A1 * 11/2010 Barnes ..... A63B 21/00 482/139
2012/0190517 A1 7/2012 Scott
2013/0225373 A1 * 8/2013 Poat ..... A63B 21/1636 482/40
2014/0200123 A1 * 7/2014 Placide ..... A63B 21/068 482/139

* cited by examiner

MULTI-PURPOSE EXERCISE DEVICE

CROSS-REFERENCE TO RELATED APPLICATIONS

This disclosure claims the benefit of U.S. Provisional Application No. 61/804,312, filed Mar. 22, 2013, which is hereby incorporated by reference in its entirety.

BACKGROUND OF THE INVENTION

1. Field of the Invention

The present disclosure generally relates to an exercise device, and, more specifically, to a multi-purpose exercise device configurable for performing strength, aerobic, stretching, or rehabilitation exercises.

2. Description of Related Art

Physical fitness is becoming an increasingly important focus in society, particularly with rising obesity levels and associated health concerns. There are a large number of exercise devices available with varying degrees of portability, affordability, stowability, and range of uses.

The most affordable and portable types of exercise machines are usually non-electrical, and composed of steel pipe or tubing. One such example is U.S. Pat. No. 7,658,702 to Harms, which discloses an adjustable push-up bench. Another example is U.S. Pat. No. 5,080,352 to Freed, which discloses a multi-purpose exercise machine for strengthening the abdominal muscles.

However, these exercise machines are limited in their functionality because they are typically adapted for one type of exercise, such as push-ups or abdominal crunches. While the above described exercise machines have had a widespread use for a number of years, there exists a need for an affordable, easily assembled exercise device which can be positioned horizontally or vertically and can be used for a range of exercises including push-ups, pull-ups, rows, and dips. Additionally, there is a need in the art for an exercise device configurable for performing a variety of exercises, including, without limitation, strength, aerobic, stretching, or rehabilitation exercises.

SUMMARY OF THE INVENTION

Generally, provided is an exercise device that addresses or overcomes some or all of the drawbacks and deficiencies discussed above in connection with existing exercise machines.

In view of the shortcomings of the existing exercise machines, it is desirable to provide an exercise device that is configurable for performing strength, aerobic, stretching, or rehabilitation exercises. There is an additional need in the art for an affordable, easily assembled exercise device which can be positioned horizontally or vertically and can be used for a range of exercises including push-ups, pull-ups, rows, and dips.

In order to address the shortcomings of the existing exercise machines, a multi-purpose exercise device in accordance with one embodiment may include a frame made from metal tubing. The frame may include two side assemblies each including a longer longitudinally extending member and a shorter L-shaped member secured to the longitudinally extending member. Each side assembly may further include two identical angled end pieces at each end to form a generally L-shaped side assembly having angled ends. The two side assemblies may be secured to each other by cross braces. The end pieces include 25°-45° outwardly extending bends formed therein such that the multi-purpose exercise device may be oriented vertically between a wall and a floor, horizontally along a floor, or horizontally with one end raised by being placed upon a stationary object. The angle of the end pieces may allow for weight to be transferred from the frame to the supporting wall or floor to keep the position of the device stable during use. A second brace, such as a pull-up bar may be included. The frame may be assembled according to a variety of techniques, including using fasteners, such as bolts or rivets passing through the frame members, or socket joints that utilize spring-loaded dowel pins. The angled end pieces may flare outwardly and incorporate rubber end caps to further stabilize the position of the device. According to an alternative embodiment, two U-shaped and outwardly flared angled end pieces are provided that bridge the end of the frame. Non-slip rubber sleeves may be provided on the U-shaped angled end piece to further stabilize the position of the device.

In another embodiment, an exercise device may include a first side assembly having a first side assembly short side with an angled first side assembly front foot, a first side assembly long side with an angled first side assembly back foot, and a first elbow provided between the first side assembly short side and the first side assembly long side. Additionally, the exercise device may include a second side assembly located parallel to the first side assembly, the second side assembly having a second side assembly short side with an angled second side assembly front foot, a second side assembly long side with an angled second side assembly back foot, and a second elbow provided between the second side assembly short side and the second side assembly long side. At least one brace may be provided for connecting the first side assembly to the second side assembly. The first elbow and the second elbow may be substantially right-angled.

In accordance with a further embodiment, a pull-up bar may be provided for connecting the first side assembly and the second side assembly. The pull-up bar may be perpendicular to the first side assembly and the second side assembly. The pull-up bar may be located at the first side assembly short side and the second side assembly short side and have end caps on opposing terminal ends. Similarly, the first side assembly front foot and the first side assembly back foot may have end caps and the second side assembly front foot and the second side assembly back foot may have end caps. A second brace may be positioned perpendicular to the first side assembly and the second side assembly. The second brace may be located at the first side assembly short side and the second side assembly short side.

In yet another embodiment, the first side assembly front foot and the second side assembly front foot may connect to form a front triangular base and the first side assembly back foot and the second side assembly back foot may connect to form a back triangular base. The front triangular base and the back triangular base each may have at least one rubber protector.

In accordance with yet another embodiment, at least one joint may be provided on one or both of the first side assembly and the second side assembly. The at least one joint may be formed from a first joint end with an inner diameter smaller than an outer diameter of a second joint end, such that the second joint end is slidably insertable into the first joint end to be connected by one or more fasteners. One of the first joint end and the second joint end may have one or more spring-loaded dowel pins which align with a hole in the other of the first joint end and the second joint end.

In a further embodiment, a multi-purpose exercise device may include a first side assembly having a first side assembly short side with an angled first side assembly front foot, a first side assembly long side with an angled first side assembly back foot, and a first elbow provided between the first side assembly short side and the first side assembly long side. Additionally, the exercise device may include a second side assembly located parallel to the first side assembly, the second side assembly having a second side assembly short side with an angled second side assembly front foot, a second side assembly long side with an angled second side assembly back foot, and a second elbow provided between the second side assembly short side and the second side assembly long side. At least one brace may be provided for connecting the first side assembly to the second side assembly. Additionally, a pull-up bar may be located at the first side assembly short side and the second side assembly short side for connecting the first side assembly and the second side assembly. The at least one brace and the pull-up bar may be perpendicular to the first side assembly and the second side assembly.

In yet another embodiment, a method for performing exercise using the exercise device described above may include positioning the device such that the first side assembly short side and second side assembly short side are resting against a first surface and the first side assembly long side and second side assembly long side are resting against a second surface. One of the first side assembly short side, first side assembly long side, and the pull-up bar may be gripped with one hand and one of the second side assembly short side, second side assembly long side, and the pull-up bar may be gripped with the other hand prior to performing an exercise. In a first configuration, the user may grip the first side assembly long or short side with one hand and the second side assembly long or short side with the other hand. In a second configuration, the user may grip the pull-up bar with both hands. In a third configuration, the user may grip the first side assembly long side with one hand and the second side assembly long side with the other hand. In a fourth configuration, the user may grip the first side assembly long side or the pull-up bar with one hand and the second side assembly long side or the pull-up bar with the other hand. The exercise may be a push-up exercise performed by positioning the device such that the first side assembly long side and second side assembly long side are resting against a floor and the first side assembly short side and second side assembly short side are resting against a floor, gripping the first side assembly long or short side with one hand and the second side assembly long or short side with the other hand, and pushing oneself up.

Alternatively, the exercise may be a pull-up exercise performed by positioning the device such that the first side assembly long side and second side assembly long side are resting against a floor and the first side assembly short side and second side assembly short side are resting against a wall, gripping the pull-up bar with both hands, and pulling oneself up.

In another alternative configuration, the exercise may be a dip exercise performed by positioning the device such that the first side assembly long side and second side assembly long side are resting against a wall and the first side assembly short side and second side assembly short side are resting against a floor, gripping the first side assembly long side with one hand and the second side assembly long side with the other hand, and lowering oneself down.

In yet another configuration, the exercise may be a row exercise performed by positioning the device such that the first side assembly long side and second side assembly long side are resting against a floor and the first side assembly short side and second side assembly short side are resting against a floor, gripping the first side assembly long side or the pull-up bar with one hand and the second side assembly long side or the pull-up bar with the other hand, and pulling oneself up.

These and other features and characteristics of the exercise device, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF THE PREFERRED EMBODIMENTS

Figure 1A:
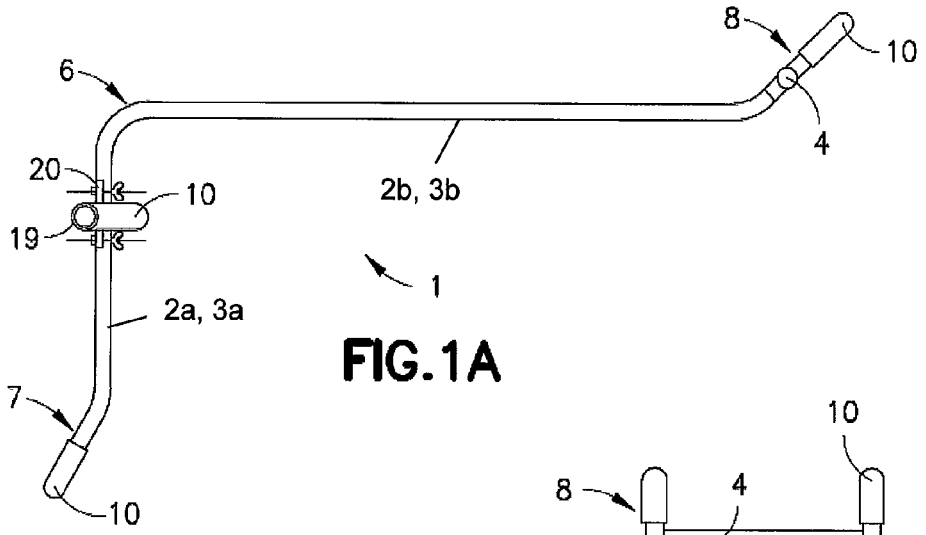
FIG. 1A is a side view of an exercise device according to an embodiment of the present disclosure.

The following description is provided to enable those skilled in the art to make and use the described embodiments contemplated for carrying out the various embodiments described herein. Various modifications, equivalents, variations, and alternatives, however, will remain readily apparent to those skilled in the art. Any and all such modifications, variations, equivalents, and alternatives are intended to fall within the spirit and scope of the present invention. Further, for purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. For the purpose of facilitating understanding of the invention, the accompanying drawings and description illustrate preferred embodiments thereof, from which the invention, various embodiments of its structures, construction and method of operation, and many advantages may be understood and appreciated.

As discussed hereinafter, the present invention is directed to an exercise device, and, more specifically, to a multi-purpose exercise device. It should be noted that this term—"exercise device"—encompasses any type of a device configurable for performing strength, aerobic, stretching, or rehabilitation exercises. Various embodiments of the exercise device (alone and/or in combination with other elements) are shown and illustrated in FIGS. 1A-5.

Figure 1C:
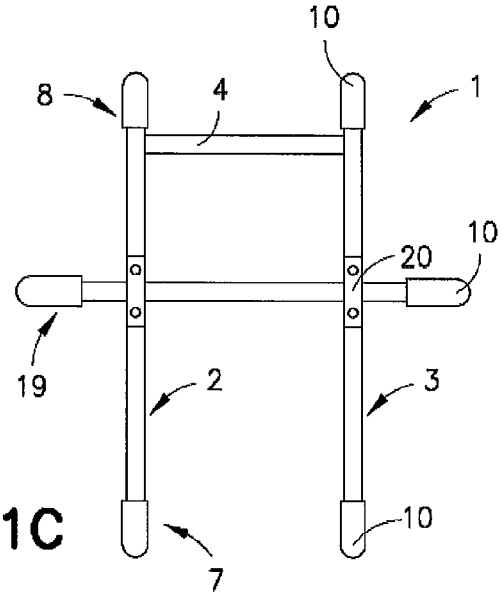
FIG. 1C is a front view of the exercise device shown in FIG. 1A.
Figure 1B:
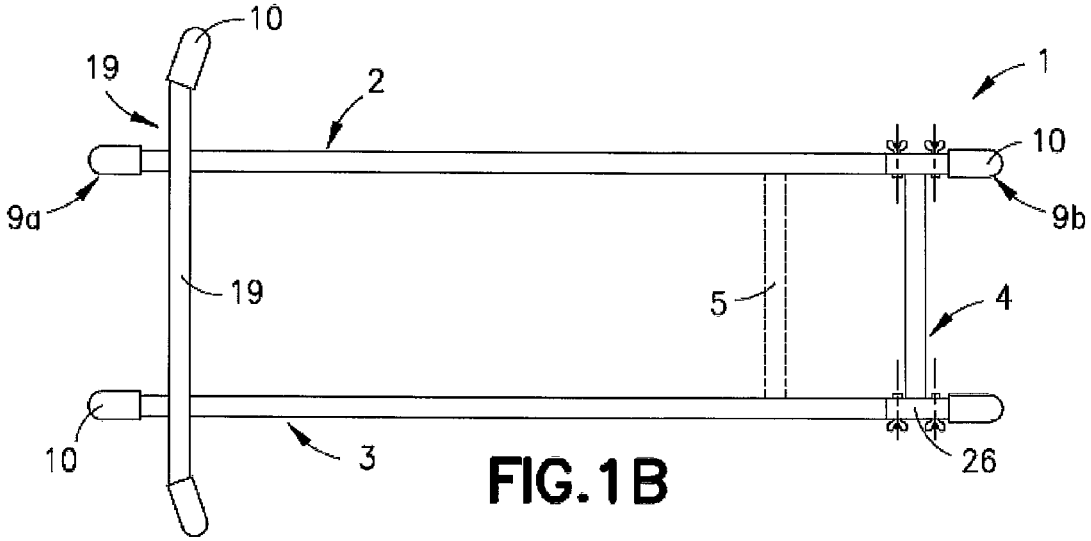
FIG. 1B is a top view of the exercise device shown in FIG. 1A.

With reference to FIGS. 1A-1C, an exercise device is shown in accordance with one embodiment. In general, the exercise device includes a frame 1. As best shown in FIG. 1C, the frame 1 is formed from a first side assembly 2 having a short side 2*a* and a long side 2*b* that is connected to a second side assembly 3 having a short side 3*a* and a long side 3*b* via a first brace 4. The first side assembly 2 is substantially parallel to the second side assembly 3. As best shown in FIG. 1A, each side assembly 2, 3 includes an elbow 6 having a substantially right-angle shape. The elbow 6 defines an L-shape at the same position along the longitudinal length of both the first side assembly 2 and the second side assembly 3. The first brace 4 is connected to the first side assembly 2 and second side assembly 3 by a connection such as a bolted flange, a weld, one or more rivets or fasteners, adhesive, or any other method known to be suitable to those having ordinary skill in the art. The first brace 4 may be removably connected to the first side assembly 2 and the second side assembly 3 to facilitate disassembly of the exercise device. Alternatively, the first brace 4 may be permanently connected to the first side assembly 2 and the second side assembly 3. A second brace 5 may be provided opposite the first brace 4 to increase the rigidity of the exercise device.

The first side assembly 2 and second side assembly 3 each have a first end piece 7 provided at one terminal end and a second end piece 8 provided at the opposing terminal end. The first end piece 7 and second end piece 8 are bent from the first side assembly 2 and the second side assembly 3 at an angle between 25° and 45° relative to the longitudinal axis of the first and second side assemblies 2, 3. The first end piece 7 and the second end piece 8 may be bent in the same plane or a different plane as the elbow 6. The first end piece 7 and the second end piece 8 are equipped with angled feet 9*a*, 9*b*. Similar to the first end piece 7 and the second end piece 8, the angled feet 9*a*, 9*b* may be bent in the same plane or a different plane as the elbow 6 and the first end piece 7 and the second end piece 8. To protect surfaces and prevent slippage of the exercise device relative to a floor or wall surface, feet 9*a*, 9*b* can be fitted with rubber end caps 10.

The bends in the elbow 6, first and second end pieces 7, 8, and the feet 9*a*, 9*b* may be formed by bending a single piece of material, such as a metal tube, or by welding a plurality of individual pieces. The bends may be radiused for a smooth angular transition or they can be sharp for an abrupt angular transition.

Figure 4:
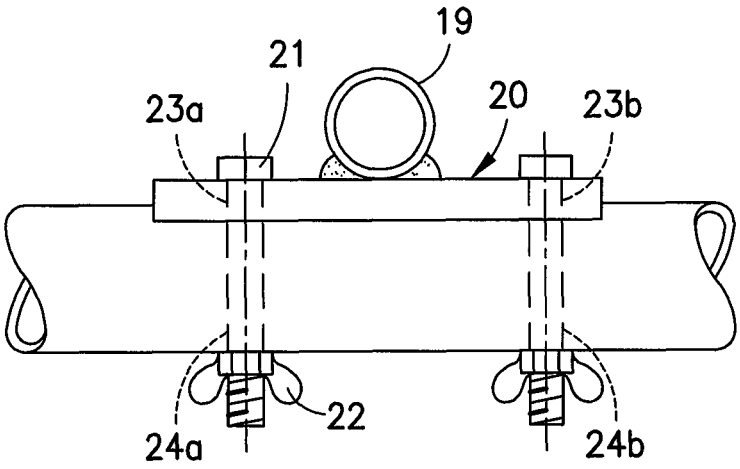
FIG. 4 is a side view of the pull-up bar connection on the exercise device of FIG. 1.

A pull-up bar 19 is provided between the elbow 6 and the first end piece 7. The pull-up bar 19 also serves as a brace to connect and reinforce the first side assembly 2 and the second side assembly 3. Similar to the first brace 4, the pull-up bar 19 may be removably or permanently connected to the first side assembly 2 and the second side assembly 3. In one embodiment, the pull-up bar 19 is connected to the first side assembly 2 and the second side assembly 3 by a pull-up bar flange 20, which is connected perpendicularly to the pull-up bar 19. With reference to FIG. 4, the pull-up bar flange 20 has two bolt holes 23*a*, 23*b* which are spaced apart and line up with bores 24*a*, 24*b* formed through the first side assembly 2 and the second side assembly 3. A bolt 21 can then be fastened and secured with a wingnut 22 to facilitate the assembly and disassembly of the pull-up bar 19. Various other fasteners known in the art may also be used to connect the pull-up bar 19. The pull-up bar 19 can also have rubber end caps 10 to provide a secure gripping surface during exercise. The engagement between the pull-up bar 19 and one of the first side assembly 2 and the second side assembly 3 by way of the pull-up bar flange 20 is shown in detail in FIG. 4.

The engagement between the first brace 4 and one of the first side assembly 2 and the second side assembly 3 by way of the brace flange 26 may be affected in a similar manner to the engagement between the pull-up bar 19 and one of the first side assembly 2 and the second side assembly 3. The first brace 4 connects to the first side assembly 2 and second side assembly 3 with a brace flange 26 similar to the pull-up bar flange 20 discussed above. The brace flange 26 utilizes the same type of bolt 21, wingnut 22, bolt holes 23*a*, 23*b*, and bore holes 24*a*, 24*b* as the pull-up bar flange 20. In one embodiment, the first brace 4 and the pull-up bar 19 may be connected to the first and second side assemblies 2, 3 using ⅜ inch diameter, 2 inch long bolts. In this embodiment, the wingnut 22 desirably has a ⅜ inch diameter to properly mate with the bolt 21. Various other fasteners known in the art may also be used to connect the first brace 4.

Figure 2A:
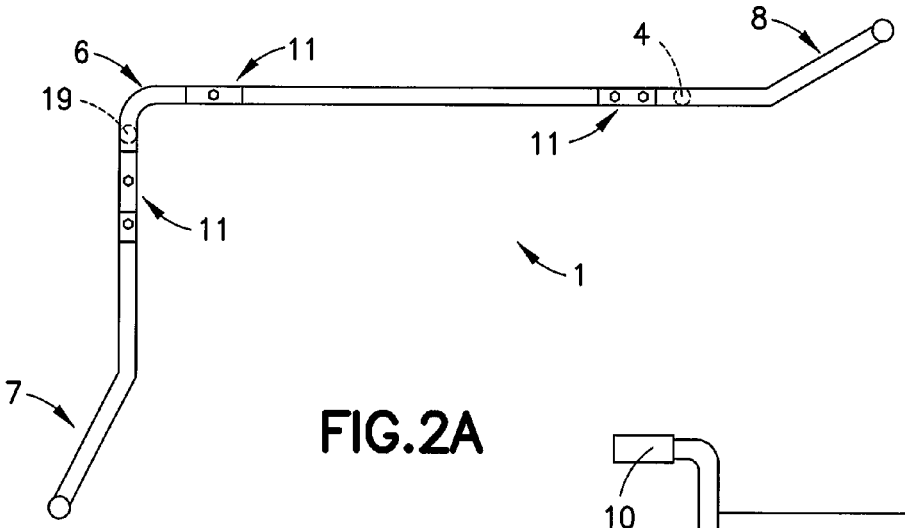
FIG. 2A is a side view of an exercise device according to an embodiment of the present disclosure.
Figure 2C:
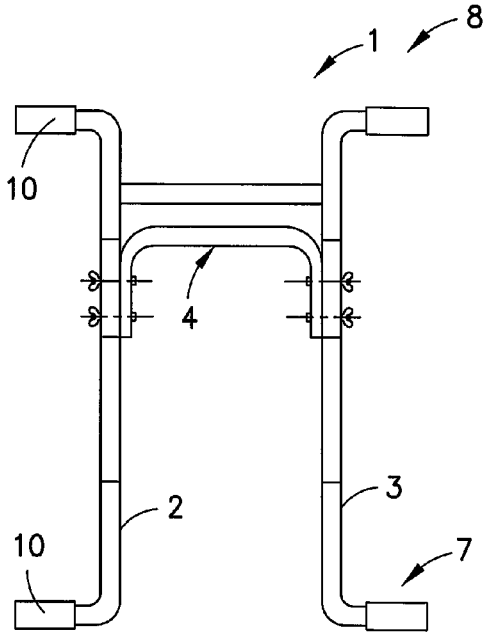
FIG. 2C is a front view of the exercise device shown in FIG. 2A.
Figure 2B:
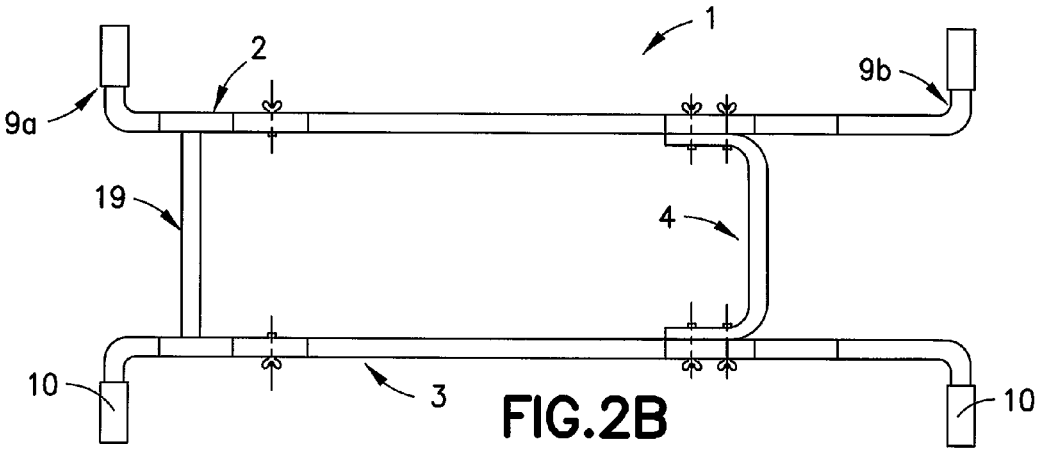
FIG. 2B is a top view of the exercise device shown in FIG. 2A.

An alternative embodiment of the exercise device is shown in FIGS. 2A-2C. In this embodiment, the frame 1 can be assembled and disassembled into several pieces via a series of joints 11. While FIG. 2A shows an embodiment with three joints 11, one of ordinary skill in the art will understand that more or fewer joints can be used depending on the objective of the manufacturer. With an increase in the number of joints 11, the length of the individual pieces forming the frame 1 can be made shorter.

Figure 5:
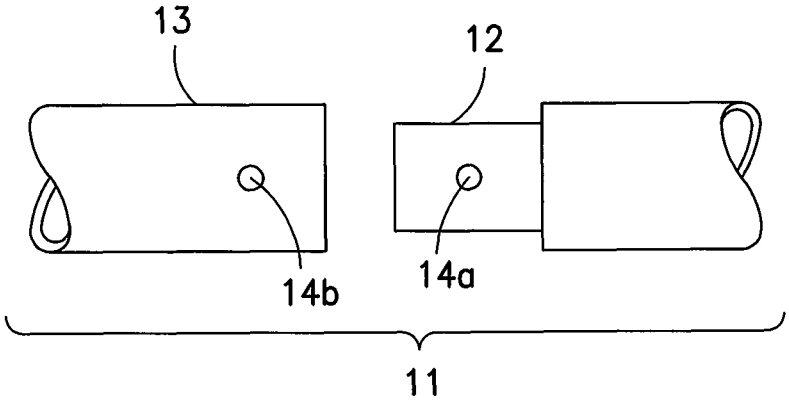
FIG. 5 is a side view of the joint detail of the exercise device of FIG. 2.
Figure 6:
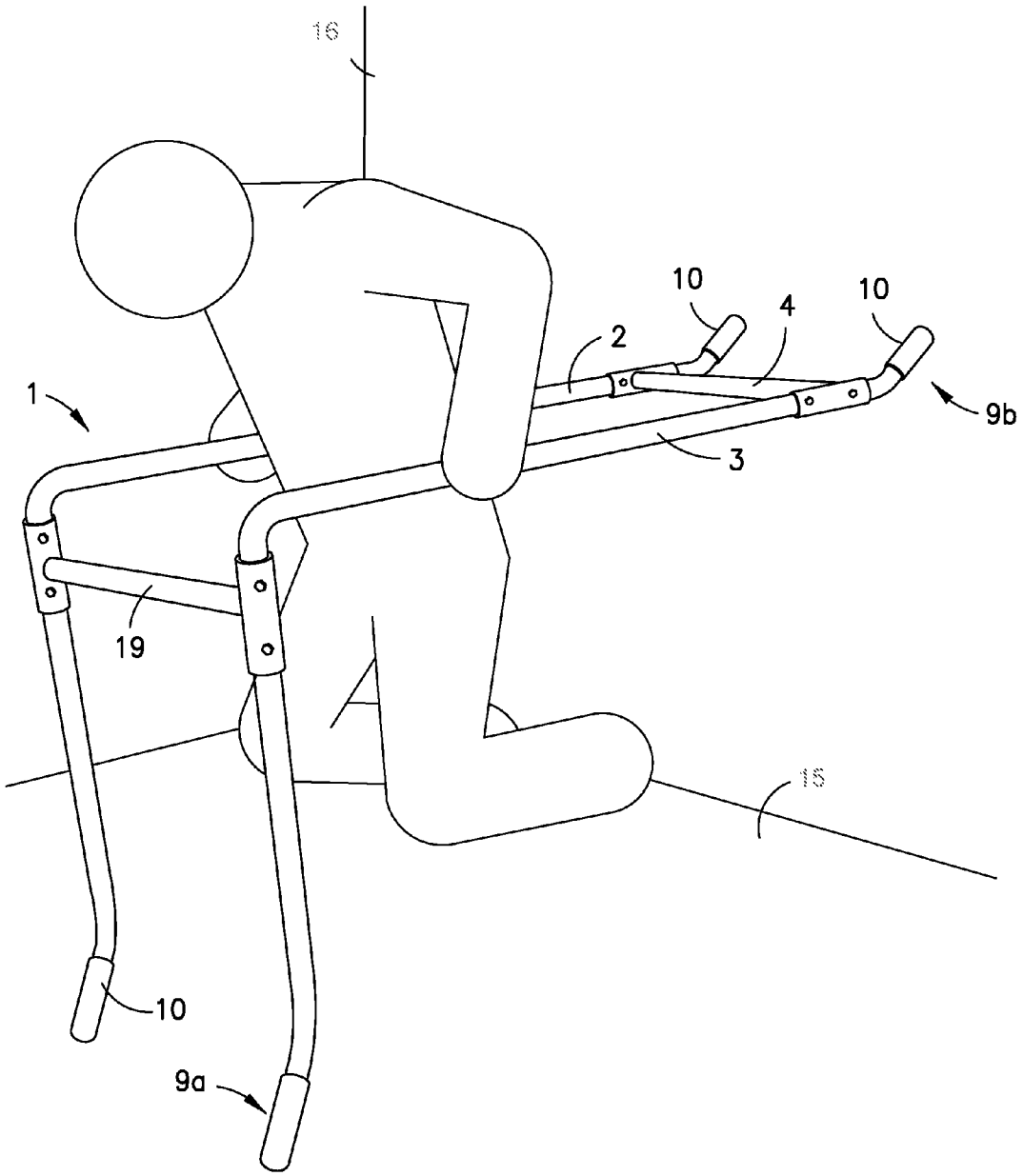
FIG. 6 is an illustration of the exercise device during use for performing dips on the exercise device.
Figure 7:
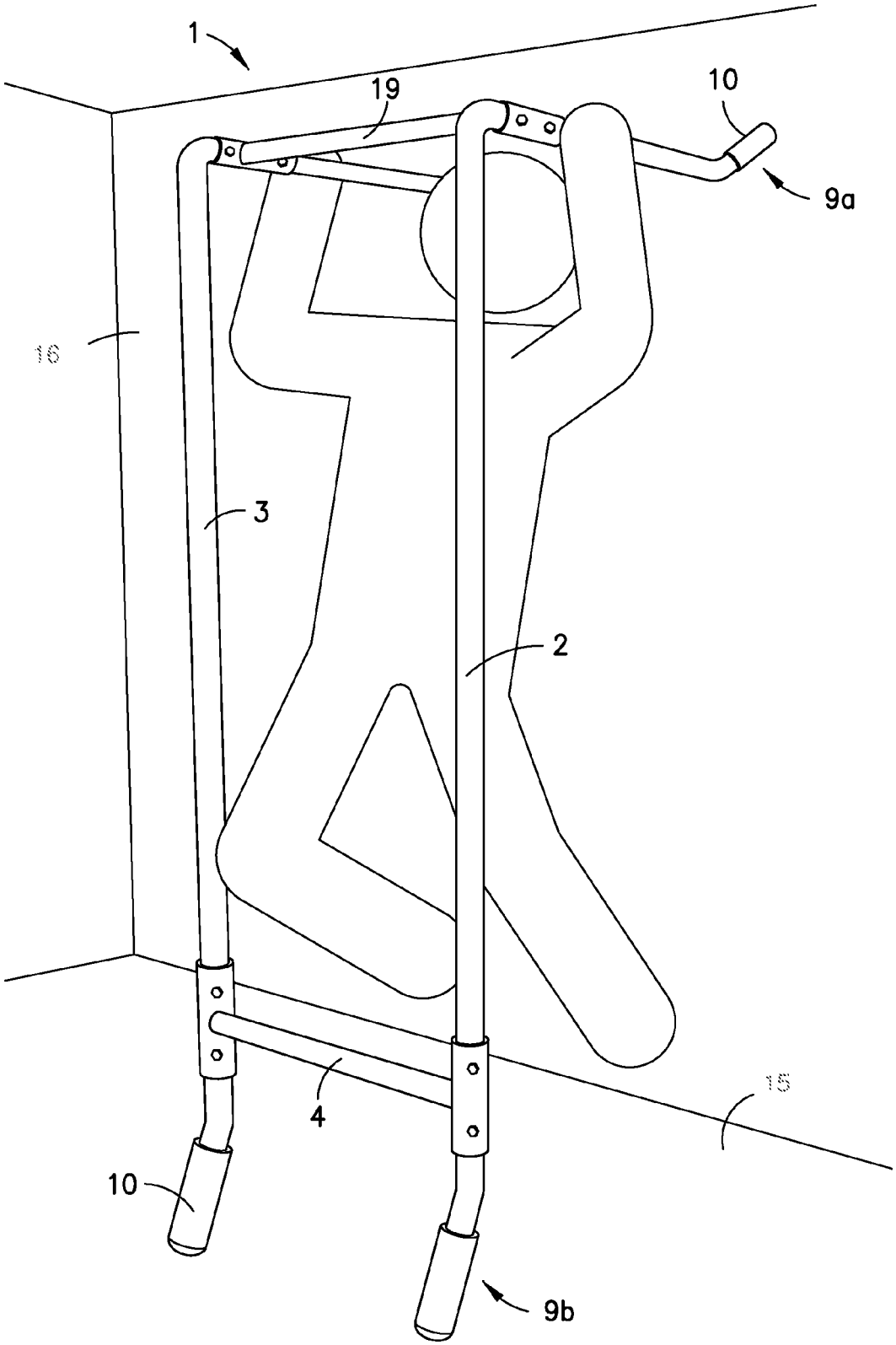
FIG. 7 is an illustration of the exercise device during use for performing pull-ups on the exercise device.

With specific reference to FIG. 5, the joint 11 is formed from a first joint end 12 with an inner diameter smaller than the outer diameter of a second joint end 13. The second joint end 13 slides into the first joint end 12 and connects by one or more fasteners. Aligning a drilled hole 14*a* in the first joint end 12 with a drilled hole 14*b* in the second joint end 13 allows a user to secure the joint using a bolt or screw. Alternatively, the second joint end 13 could contain one or more spring-loaded dowel pins which align with the drilled hole 14*a* in the first joint end 12. When a user depresses the dowel pins and inserts the second joint end 13 into the first joint end 12, the dowel pins will release when aligned with the drilled hole 14*a* to create a secured connection. The first joint end 12 and the second joint end 13 may be formed at any portion of the first or second side assembly 2, 3.

Figure 3A:
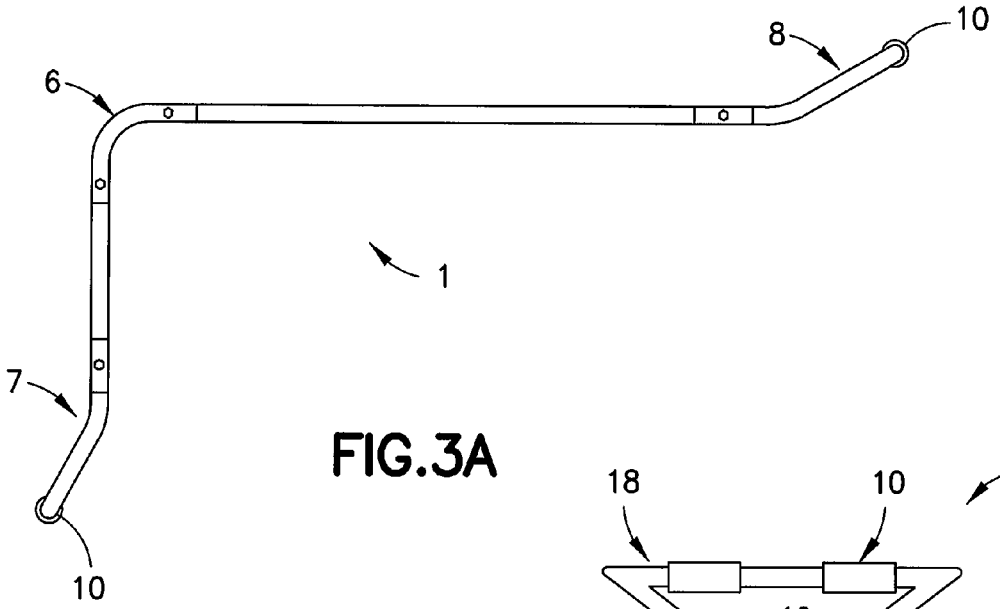
FIG. 3A is a side view of an exercise device according to an embodiment of the present disclosure.
Figure 3C:
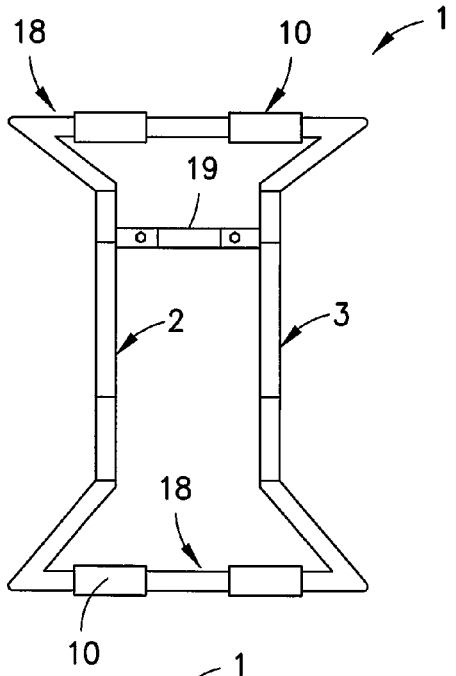
FIG. 3C is a front view of the exercise device shown in FIG. 3A.
Figure 3B:
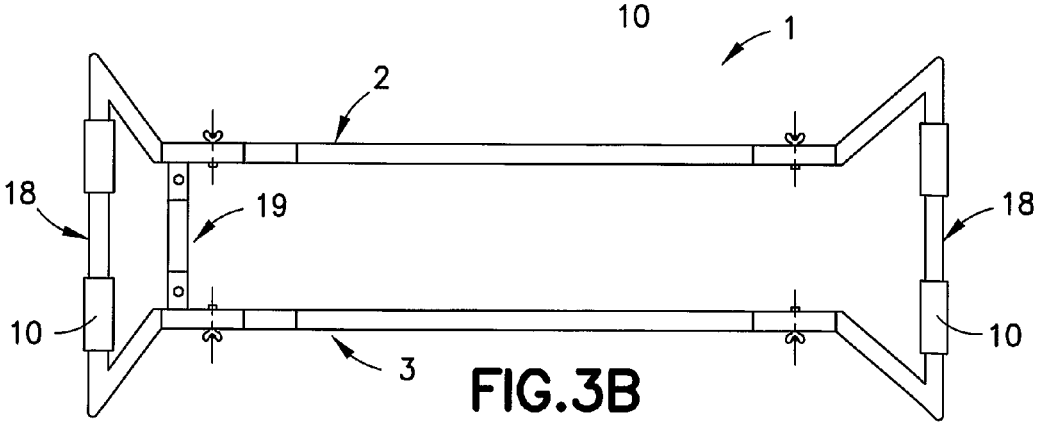
FIG. 3B is a top view of the exercise device shown in FIG. 3A.

FIGS. 3A-3C are illustrative of an alternative design for stabilizing the device, in which, instead of using multiple feet 9*a*, 9*b*, the frame 1 can be stabilized with triangular feet 18. The triangular feet 18 form a continuous piece of tubing connecting the first side assembly 2 and the second side assembly 3. Because of the connections at either end of the frame 1, the second brace 5 may be excluded.

The frame 1 is generally formed from a hollow tubular material, such as a round tube. In each embodiment, the tube is desirably made from a material that is strong enough to support the weight of a user. In one embodiment, the tube is a 1-½ inch diameter steel tube. However, any material of construction, ideally a metal or heavy duty plastic, would suffice. One of ordinary skill in the art would appreciate that other suitable materials are not precluded. The frame 1 may be painted, powder coated, or otherwise protected to prevent rusting or damage due to weather.

Figure 8:
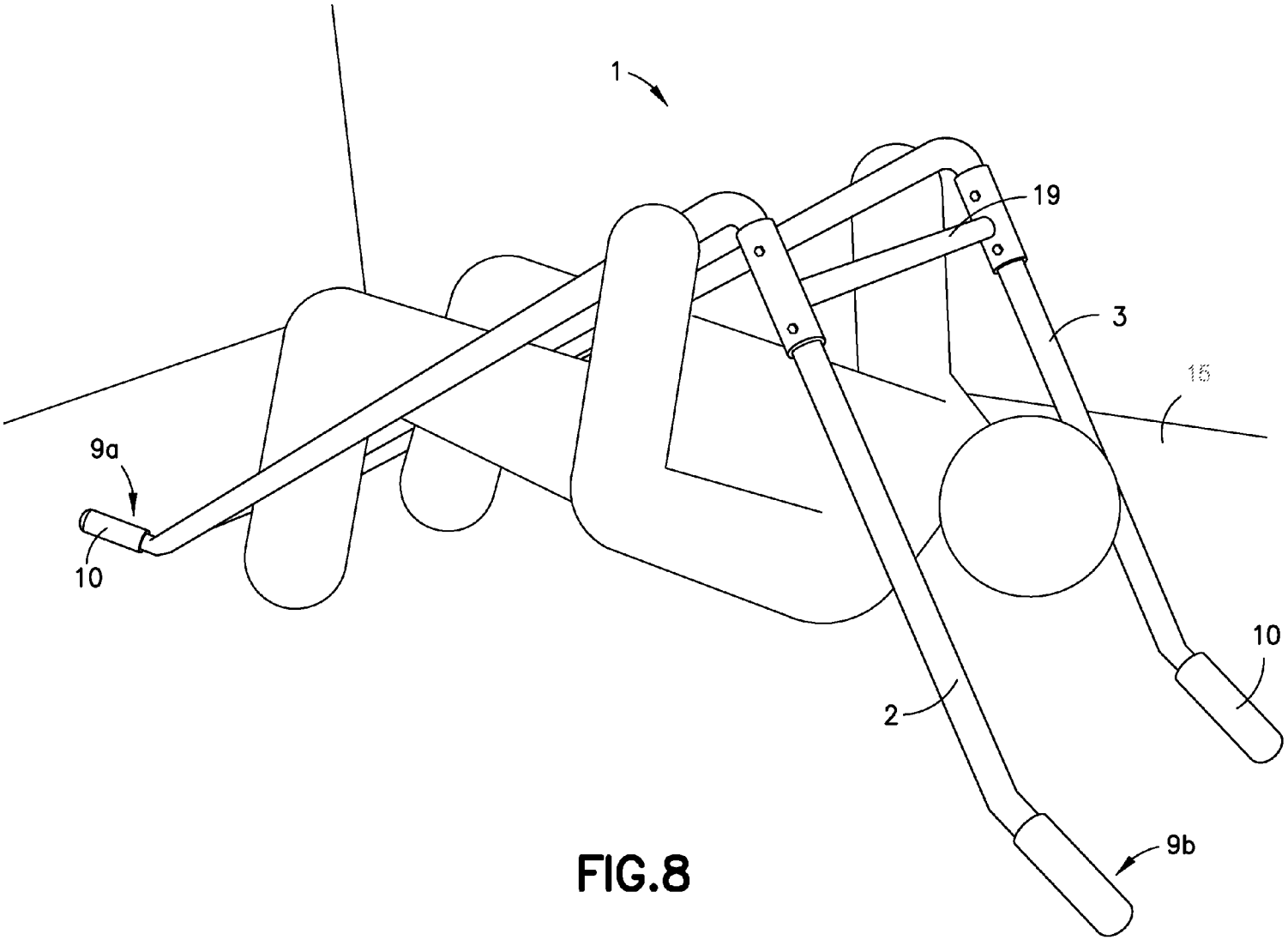
FIG. 8 is an illustration of the exercise device during use for performing rows on the exercise device.
Figure 9:
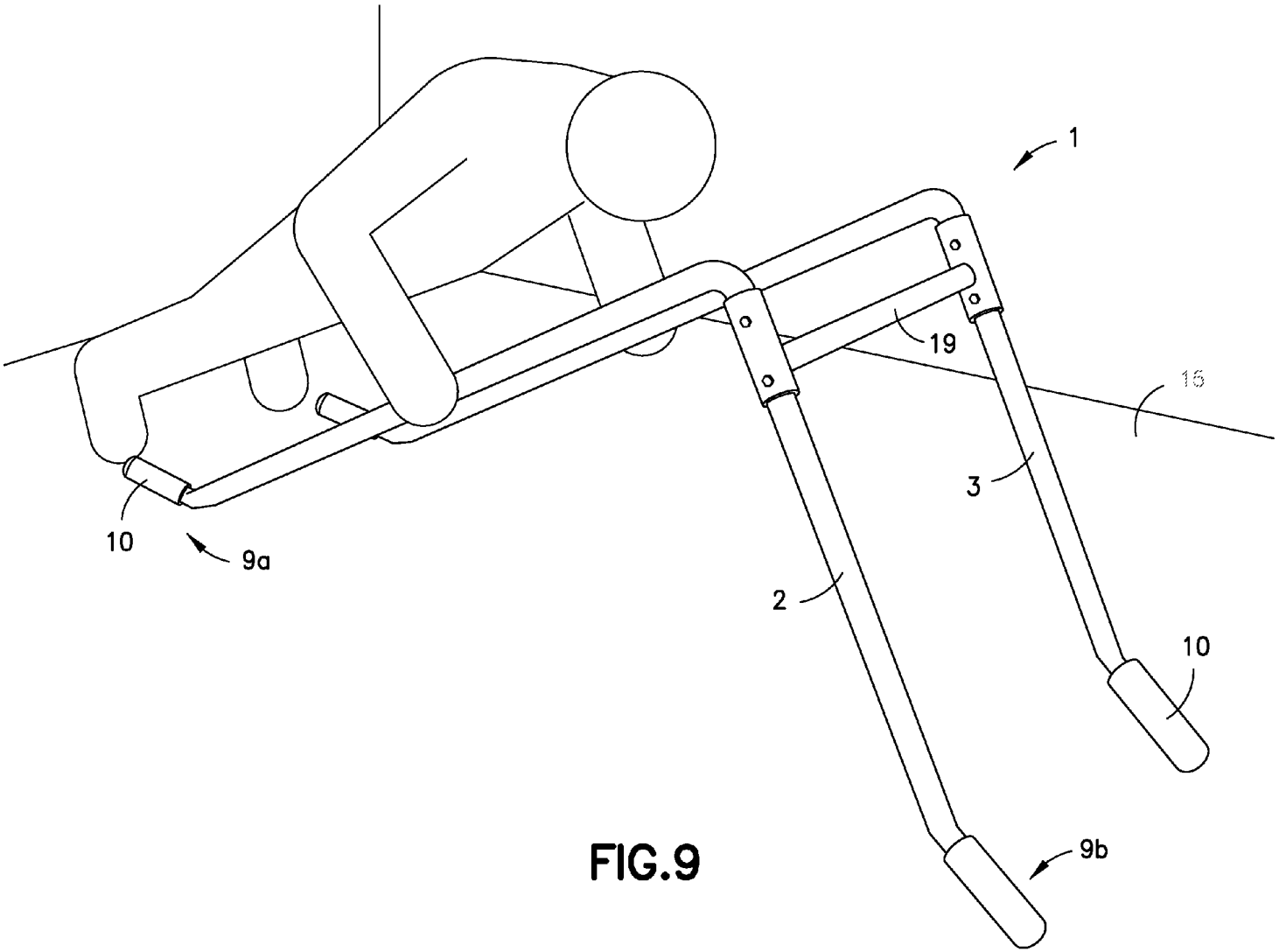
FIG. 9 is an illustration of the exercise device during use for performing push-ups on the exercise device.

With reference to FIGS. 6-9, the exercise device described above with reference to any one of FIGS. 1A-5 can be positioned relative to the floor and wall surface to allow the user to perform a multitude of exercises. For example, the arrangement in FIG. 6, in which the angled foot 9*a* is placed on the floor 15 and foot 9*b* is placed on the wall 16, allows the user to perform exercises which require two bars parallel to the floor, such as dips. The arrangement in FIG. 7, in which the angled foot 9*a* is placed on the wall 16 and foot 9*b* is placed on the floor 15, allows the user to perform exercises, such as pull-ups, which require two bars parallel to the floor at a higher elevation than the arrangement in FIG. 4. FIGS. 8-9 show alternative exercises when both of the angled feet 9*a* and 9*b* are placed on the floor 15. FIG. 8 illustrates an embodiment where the exercise machine is used for performing rows in which the user hangs downward from the first and second side assemblies 2, 3. FIG. 9 illustrates an embodiment in which the exercise machine is used for performing push-ups in which the user pushes up on the first and second side assemblies 2, 3. Optionally, a stationary object, such as a block, can be placed under the angled feet 9*a* and 9*b* to change the incline of the exercise device, so that a user can increase or decrease the difficulty of the exercise, or to isolate different muscle groups through a different incline. It is to be appreciated, though, that the exercise device described above with respect to any one of the embodiments of FIGS. 1A-5 may be used in any manner and to perform any exercise that a user determines to be effective and beneficial.

While specific embodiments of the exercise device have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof. Further, although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An exercise device comprising:

a first side assembly having a first side assembly short side with an angled first side assembly front foot, a first side assembly long side with an angled first side assembly back foot, and a first elbow provided between the first side assembly short side and the first side assembly long side;

a second side assembly located parallel to the first side assembly, the second side assembly having a second side assembly short side with an angled second side assembly front foot, a second side assembly long side with an angled second side assembly back foot, and a second elbow provided between the second side assembly short side and the second side assembly long side; and at least one brace for connecting the first side assembly to the second side assembly, wherein the exercise device is configured for use in the following configurations:

(a) the first side assembly front foot and the second side assembly front foot are positioned on a floor surface, and the first side assembly back foot and the second side assembly back foot are positioned on a wall surface to perform at least a first exercise;

(b) the first side assembly front foot and the second side assembly front foot are positioned on the wall surface, and the first side assembly back foot and the second side assembly back foot are positioned on the floor surface to perform at least a second exercise; and (c) the first side assembly front foot, the second side assembly front foot, the first side assembly back foot, and the second side assembly back foot are positioned on the floor surface to perform at least a third exercise.

2. The exercise device of claim 1, further comprising a second brace connecting the first side assembly and the second side assembly, wherein the second brace is a pull-up bar.

3. The exercise device of claim 1, wherein the first elbow and the second elbow are substantially right-angled.

4. The exercise device of claim 2, wherein the pull-up bar is perpendicular to the first side assembly and the second side assembly.

5. The exercise device of claim 2, wherein the pull-up bar is located at the first side assembly short side and the second side assembly short side.

6. The exercise device of claim 2, wherein the pull-up bar has end caps on opposing terminal ends.

7. The exercise device of claim 1, wherein:

the first side assembly front foot and the first side assembly back foot have end caps; and the second side assembly front foot and the second side assembly back foot have end caps.

8. The exercise device of claim 1, further comprising a second brace positioned perpendicular to the first side assembly and the second side assembly.

9. The exercise device of claim 8, wherein the second brace is located at the first side assembly short side and the second side assembly short side.

10. The exercise device of claim 1, wherein:

the first side assembly front foot and the second side assembly front foot connect to form a front triangular base; and the first side assembly back foot and the second side assembly back foot connect to form a back triangular base.

11. The exercise device of claim 10, wherein the front triangular base and the back triangular base each has at least one rubber protector.

12. The exercise device of claim 1, further comprising at least one joint provided on one or both of the first side assembly and the second side assembly.

13. The exercise device of claim 12, wherein the at least one joint is formed from a first joint end with an inner diameter smaller than an outer diameter of a second joint end, such that the second joint end is slidably insertable into the first joint end to be connected by one or more fasteners.

14. The exercise device of claim 13, wherein one of the first joint end and the second joint end has one or more spring-loaded dowel pins which align with a hole in the other of the first joint end and the second joint end.

15. A multi-purpose exercise device comprising:

a first side assembly having a first side assembly short side with an angled first side assembly front foot, a first side assembly long side with an angled first side assembly back foot, and a first elbow provided between the first side assembly short side and the first side assembly long side;

a second side assembly located parallel to the first side assembly, the second side assembly having a second side assembly short side with an angled second side assembly front foot, a second side assembly long side with an angled second side assembly back foot, and a second elbow provided between the second side assembly short side and the second side assembly long side;

at least one brace for connecting the first side assembly to the second side assembly; and a pull-up bar located at the first side assembly short side and the second side assembly short side for connecting the first side assembly and the second side assembly, wherein the at least one brace and the pull-up bar are perpendicular to the first side assembly and the second side assembly, wherein the exercise device is configured for use in the following configurations:

(a) the first side assembly front foot and the second side assembly front foot are positioned on a floor surface, and the first side assembly back foot and the second side assembly back foot are positioned on a wall surface to perform at least a first exercise;

(b) the first side assembly front foot and the second side assembly front foot are positioned on the wall surface, and the first side assembly back foot and the second side assembly back foot are positioned on the floor surface to perform at least a second exercise; and (c) the first side assembly front foot, the second side assembly front foot, the first side assembly back foot, and the second side assembly back foot are positioned on the floor surface to perform at least a third exercise.

16. A method for an individual performing exercise using the exercise device of claim 2, comprising:

positioning the device such that:

(a) the first side assembly front foot and the second side assembly front foot are positioned on the floor surface, and the first side assembly back foot and the second side assembly back foot are positioned on the wall surface;

(b) the first side assembly front foot and the second side assembly front foot are positioned on the wall surface, and the first side assembly back foot and the second side assembly back foot are positioned on the floor surface; or (c) the first side assembly front foot, the second side assembly front foot, the first side assembly back foot, and the second side assembly back foot are positioned on the floor surface; and performing an exercise.

17. The method of claim 16, wherein the exercise is a push-up exercise performed by:

positioning the device such that the first side assembly front foot, the second side assembly front foot, the first side assembly back foot, and the second side assembly back foot are resting against the floor surface;

gripping the first side assembly long or short side with one hand and the second side assembly long or short side with the other hand; and pushing oneself up.

18. The method of claim 16, wherein the exercise is a pull-up exercise performed by:

positioning the device such that the first side assembly front foot and the second side assembly front foot are positioned on the floor surface, and the first side assembly back foot and the second side assembly back foot are positioned on the wall surface;

gripping the pull-up bar with both hands; and pulling oneself up.

19. The method of claim 16, wherein the exercise is a dip exercise performed by:

positioning the device such that the first side assembly front foot and the second side assembly front foot are positioned on the wall surface, and the first side assembly back foot and the second side assembly back foot are positioned on the floor surface;

gripping the first side assembly long side with one hand and the second side assembly long side with the other hand; and lowering oneself down.

20. The method of claim 16, wherein the exercise is a row exercise performed by:

positioning the device such that the first side assembly front foot, the second side assembly front foot, the first side assembly back foot, and the second side assembly back foot are resting against the floor surface;

gripping the first side assembly long side or the pull-up bar with one hand and the second side assembly long side or the pull-up bar with the other hand; and pulling oneself up.

* * * * *